US005143099A

United States Patent [19]

Le Gars et al.

[11] Patent Number: 5,143,099

[45] Date of Patent: Sep. 1, 1992

[54] DOUBLE WRAPPED CIGARETTES WITH REDUCED SPOTTING AND METHOD OF MANUFACTURE

[75] Inventors: Marcelle Le Gars, Quimperle; Nicolas Baskevitch, Parigne l'Eveque, both of France

[73] Assignee: Papeteries de Mauduit, Quimprele Cedex, France

[21] Appl. No.: 566,600

[22] Filed: Aug. 13, 1990

[30] Foreign Application Priority Data

Aug. 14, 1989 [FR] France ..... 89 10879

[51] Int. Cl.[5] ..... A24D 1/02

[52] U.S. Cl. ..... 131/365; 131/331

[58] Field of Search ..... 131/365, 336, 335, 331

[56] References Cited

U.S. PATENT DOCUMENTS

| | | | |
|---|---|---|---|
| 3,633,589 | 1/1972 | Kahane et al. . | |
| 4,366,826 | 1/1983 | Horsewell | 131/365 |
| 4,505,282 | 3/1985 | Cogbill et al. . | |
| 4,561,454 | 12/1985 | Guess . | |
| 4,615,345 | 10/1986 | Durocher . | |
| 4,622,983 | 11/1986 | Matthews et al. . | |
| 4,779,631 | 10/1988 | Durocher et al. . | |
| 4,911,184 | 3/1990 | Case et al. | 131/365 |
| 5,007,439 | 4/1991 | Chumney, Jr. | 131/335 |

FOREIGN PATENT DOCUMENTS 1175066 7/1964 Fed. Rep. of Germany .

OTHER PUBLICATIONS

Annales Du Tabac (Paris) vol. 14, 33–43 (1976).

Investigations on the Internal Structure of Cigarette Paper W/Use of Mercury Porosimetry, Comm. to Coresta Congress, 1976, Tokyo Coresta Information Bulletin (3–4) 40–41 (1975).

W. F. Owens Recent Advances in Tobacco Science (4) 3–24 (1978) and Specifically 19–21 describing Poiseville law and Bernouilli theorem.

*Primary Examiner*—V. Millin

*Assistant Examiner*—Lynne A. Reichard

*Attorney, Agent, or Firm*—William D. Herrick

[57] ABSTRACT

The invention concerns cigarette spotting.

To reduce or prevent cigarette paper spotting, the cigarette is provided with an inner wrapper placed between the tobacco column and the external envelope, this inner wrapper being a paper made of cellulose fibers, with a basis weight at the utmost equal to 30 g/m$^2$, presenting pores made during paper manufacture, or perforations made after manufacture in such a way that the air permeability is at leaste 500 Coresta units.

This invention applies to all cigarettes and similar smoking products.

10 Claims, No Drawings

DOUBLE WRAPPED CIGARETTES WITH REDUCED SPOTTING AND METHOD OF MANUFACTURE

BACKGROUND OF THE INVENTION

1. Field of the Invention

The invention relates to processes to reduce or even prevent the formation of spots on the over wrapper of cigarettes as well as the paper used in such processes and the resulting cigarettes.

Cigarettes are generally wrapped in white cigarette paper. The degree of whiteness of a cigarette is considered as an indication of quality. Conversely, yellowing or the presence of brown spots on a cigarette paper is considered by consumers as a sign of poor quality or the cigarettes having been too long in storage. Experts know, however, that extended storage is not a prerequisite to yellowing or spotting. In fact, when cigarettes are kept under high humidity, spotting may occur within weeks or even days.

Spotting is explained by the transfer, at the point of contact between tobacco shreds and cigarette paper, of tobacco-colored constituents. Cigarette paper is a highly hydrophilic material, due to (i) the chemical nature of cellulose, with its large number of hydroxyl groups, (ii) the physical structure of the fibers presenting a microcapillarity and (iii) the porous structure of the sheet (see N. Baskevitch, *Annales du Tabac* (Paris) vol. 14, pp 33–43 (1976)).

Under the influence of high relative humidity, tobacco constituents transferred to the internal face of cigarette paper migrate through the paper to form visible discrete spots on the outside of the wrapper. No technique exists today which allows to solve a spotting problem when cigarettes are stored in extreme climatic conditions.

The object of the invention is to propose a technique allowing to solve this problem.

SUMMARY OF THE INVENTION

This is achieved, according to the invention, by providing the cigarette with an inner wrapper placed between the tobacco column and the outer wrapper. This inner wrapper comprises a paper made of cellulosic fiber, with a basis weight below 30 g/m$^2$, exhibiting pores produced during paper manufacture or perforations made after its manufacture, in such a way that the inner wrapper has an air permeability of at least 500 Coresta units.

DETAILED DESCRIPTION OF THE INVENTION

Coresta units, as defined by the "Cooperation Center for Scientific Research Related to Tobacco" (CORESTA) is the flow rate (in cm$^3$/mn) of air passing through 1 cm$^2$ area of cigarette paper under a pressure of 10 cm water gauge. Results are expressed in cm$^3$/mn/cm$^2$ or cm/mn.

As used herein, the term "cigarette" includes other generally known smoking articles. A cigarette, according to the invention, is characterized as including an inner wrapper, placed between the outer wrapper and the tobacco column being a paper made of cellulosic fiber, with a basis weight below 30 g/m$^2$, exhibiting pores produced during paper manufacture or perforations made after paper manufacture, in such a way that the inner wrapper offers an air permeability of at least 500 cm/mm (Coresta units).

Preferably, the air permeability obtained through perforations or macropores is at least 1000, or more preferred, above 1500, or even more preferred, above 3000 Coresta units.

By producing macropores, a majority of which are between 3 and 15 microns radius, one may advantageously obtain an air permeability in the range of 30,000 to 40,000 cm/m (Coresta units).

To evaluate the structure of porous papers and to distinguish between structures consisting mainly of micropores or macropores, A method is used based on the physical laws describing the flow or air through porous materials. According to Poiseuille's law, the air flow (F) through microporous capillaries is a direct function of the pressure differential ($\Delta P$) between the two faces. Air flow is laminar.

$$F = Z \times \Delta P$$

In contrast, according to the Bernouilli theorem, the air flow through macroporous orifices is a function of the square root of the pressure differential between the two faces. Air flow is turbulent.

$$F = Z \times \sqrt{\Delta P}$$

In practice, the nature of the porous structure of paper is evaluated by measuring its air permeability under two pressure differential: 0.5 and 2 cbar, and by calculating the index $$R = F\frac{2\ cbar}{4 \times F_{0.5\ cbar}}$$

An index equal to 1.0 characterizes a paper with a porous structure entirely made of micropores. Cigarette papers show generally an index in the range of 0.9 to 1.0.

An index below 0.85 characterizes a porous structure predominantly made of macropores and orifices. The papers used as inner wrapper in the invention have generally an R index, as described above, in the range 0.6 to 0.8.

It is preferred to use as the inner wrapper a paper with a basis weight as low as possible in order to minimize its influence on the taste characteristics and the tar and carbon monoxide deliveries in the smoke. According to the invention, it is preferable to use as inner wrapper a paper with a basis weight below 20 g/m$^2$, and more preferred, below 16 g/m$^2$.

According to a further embodiment of the invention, the application of a water repellent treatment to the inner wrapper allows total elimination of cigarette spotting, when needed.

The manufacture of cigarettes with a double wrap on a conventional cigarette maker should cause no special problem to those skilled in the art. It is recommended that the inner wrapper have a width corresponding exactly to the cigarette circumference, allowing its sides to join without overlap. The width of the outer wrapper will be, in preference, such as to allow an overlap of 2 to 2.5 mm.

A laboratory test has been developed that accelerates spotting of cigarette paper.

This test consists in storing the cigarettes for 72 hours in a climatic chamber (Model HO, Flam and Cie , Neuilly sur Marne, France) at 80% relative humidity and at 20° C.

A number of other experimental conditions were evaluated. The above conditions were preferred as they allow the simulation of cigarette spotting in a fast, reproducible and discriminatory way. The test result is expressed in a number of discrete spots per cigarette, with an indication of the average diameter.

All commercial cigarettes experimented under the test conditions were uniformly spotted with brown blots with a diameter above 3 mm.

Under the same test conditions, cigarettes equipped with papers, according to the invention showed no visible spots at the end of the test.

EXAMPLES

In the examples, the name of papers Verge 30C, 65-18, 13 TUC, 15 TUC, 65-18 aqua, and 80C7 are commercial grades manufactured by Papeteries de Mauduit (France).

EXAMPLE 1 (CONTROL EXPERIMENT)

Plain cigarettes, 8 mm in diameter, containing 850 mg of flue-cured tobacco, wrapped in a cigarette paper grade Verge 30C (air permeability 30 cm/mm, R index 0.99; a combustion salt, sodium and potassium citrate 0.8%) were subjected to the test conditions. After 72 hours, a large number of spots (more than 250/ cig) with an average diameter above 3 mm, were observed.

EXAMPLE 2

Cigarettes with same characteristics as control were wrapped with two layers of the same cigarette paper "Verge 30C".

The width of the inner wrapper was 25 mm.

The width of the outer wrapper was 27.5 mm. After 72 hours under test conditions, around 100 spots per cigarette, with an average diameter of 3 mm, were observed.

EXAMPLE 3

Cigarettes with the same characteristics as control were double wrapped. The inner wrapper was a paper "65-18" with an air permeability of 6500 Coresta units, an R index of 0.62 and a basis weight of 18 g/m$^2$. The outer wrapper was a cigarette paper "Verge 30C".

The width of the inner wrapper was 25 mm.

The width of the outer wrapper was 27.5 mm. After 72 hours under test conditions, around 100 spots per cigarette, with an average diameter of 1 mm, were observed.

EXAMPLE 4

Cigarettes with the same characteristics as control were double wrapped. The inner wrapper was a paper "13 TUC" with an air permeability of 3500 Coresta units, an R index of 0.60 and a basis weight of 13 g/m$^2$. The outer wrapper was a cigarette paper "Verge 30".

The width of the inner wrapper was 25 mm.

The width of the outer wrapper was 27.5 mm. After 72 hours under test conditions, around 50 spots per cigarette, with an average diameter of 1 mm, were observed.

EXAMPLE 5

Cigarettes with the same characteristics as control were double wrapped. The inner wrapper wa a paper "15 TUC" with an air permeability of 8000 Coresta units, an R index of 0.61, and a basis weight of 15 g/m$^2$. The outer wrapper was a cigarette paper "Verge 30C".

The width of the inner wrapper was 25 mm.

The width of the outer wrapper was 27.5 mm. After 72 hours under test conditions, around 50 spots per cigarette, with an average diameter of 1 mm, were observed.

EXAMPLE 6

Cigarettes with the same characteristics as control were double wrapped. The inner wrapper was a paper "65-18 aqua" with an air permeability of 600 Coresta units which had received a water-repellent treatment by addition of 0.5% of alkyletene dimer (Aquapel TM from Hercules Corp.), its R index of 0.62 and a basis weight of 18 g/m$^2$. The outer wrapper was a cigarette paper "Verge 30C".

The width of the inner wrapper was 25 mm.

The width of the outer wrapper was 27.5 mm. No spotting at all was observed after 72 hours under test conditions.

EXAMPLE 7

The nature of the tobacco blend has generally little influence on spotting of cigarettes stored under high relative humidity. Most tobaccos offer similar propensity to spotting of cigarettes with a single wrap. Mentholated blends are known to be more prone to generate cigarette spotting.

Cigarette papers, whatever their physical (basis weight, thickness) or chemical (fiber composition, filler content) characteristics show generally similar propensity to spotting as climatic conditions become extreme. The presence of combustion salts, like sodium or potassium citrate, incorporated in high concentration to cigarette paper is a worsening factor for spotting.

In order to test the invention in the most difficult conditions, an experiment was designed where a mentholated blend was combined with a cigarette paper containing a high level of potassium citrate.

CONTROL

Control cigarettes, plain, were manufactured (850 mg tobacco, 8 mm diameter) from a mentholated American blend wrapped in a single layer of cigarette paper "80 C7", with an air permeability of 80 Coresta units, an R index of 0.98 and as a combustion sale, 7% of potassium citrate.

After 72 hours under test conditions, the cigarettes were totally spotted.

EXAMPLE 8

Cigarettes with the same characteristics as the control were manufactured from the mentholated blend wrapped in two layers of paper.

The inner wrapper was a paper "65-18 aqua" with an air permeability of 6500 Coresta units and an R index of 0.62. This paper had received a water repellent treatment by addition of 0.5% alkyletene dimer. The outer wrapper was a cigarette paper 80 C7 (air permeability 80 Coresta, combustion salt: potassium citrate 7%).

After 72 hours in the climatic chamber (80% relative humidity, 20° C.), no spots at all were observed on the cigarette paper.

We claim:

1. A cigarette comprising a tobacco column and an inner and outer wrapper, wrapped around said tobacco column said inner wrapper being between the outer wrapper and the tobacco column, the improvement wherein the inner wrapper is made of cellulose fibers having a basis weight of up to 30 g/m$^2$, and having pores made during paper manufacture or perforations made after manufacture in such a way that the inner wrapper has an air permeability of at least 500 Cresta units.

2. The cigarette of claim 1, wherein the air permeability of the inner wrapper is due to pores wherein more than 50% of said pores have a radius in the range of from 3 to 15 microns.

3. The cigarette of claim 1 or claim 11, wherein the air permeability of the inner wrapper is in excess of 1500 Coresta units.

4. The cigarette of claim 2 or claim 2 wherein the air permeability of the inner wrapper is in excess of 3000 Coresta units.

5. The cigarette of claim 4 wherein the air permeability of the inner wrapper is in the range of from about 30,000 to 40,000 Coresta units.

6. The cigarette of claim 5 wherein the inner wrapper has a basis weight less than 20 g/m$^2$.

7. The cigarette of claim 6 wherein the inner wrapper has received a water repellent treatment.

8. The cigarette of claim 7 wherein the inner wrapper has received an addition of alkylketene dimer.

9. A process to reduce or even eliminate spotting of the outer wrapper of a double-wrapped cigarette, said process comprising the step of wrapping a tobacco column with an inner wrapper between the tobacco column and the outer wrapper, the improvement wherein the inner wrapper is a paper made of cellulose fibers having a basis weight up to 30 g/m$^2$, having pores made during paper manufacture or perforations made after manufacture providing the inner wrapper with an air permeability of at least 500 Coresta units.

10. The cigarette of claim 3 wherein the inner wrapper has received a water repellent treatment.

* * * * *